US006364188B1

(12) United States Patent
Dunshee

(10) Patent No.: US 6,364,188 B1
(45) Date of Patent: Apr. 2, 2002

(54) TAPE DISPENSER

(76) Inventor: Wayne K. Dunshee, P.O. Box 33427, St. Paul, MN (US) 55133-3427

( * ) Notice: Subject to any disclaimer, the term of this patent is extended or adjusted under 35 U.S.C. 154(b) by 0 days.

(21) Appl. No.: 09/465,249

(22) Filed: Dec. 18, 1999

Related U.S. Application Data

(60) Continuation-in-part of application No. 29/109,681, filed on Aug. 20, 1999, which is a division of application No. 29/097,492, filed on Dec. 8, 1998, now Pat. No. Des. 416,582.

(51) Int. Cl.[7] ..... B65H 35/10
(52) U.S. Cl. ..... 225/1; 225/51; 225/56; 206/407; 242/601; 242/422.5
(58) Field of Search ..... 225/56, 59, 61, 225/62, 66, 77, 51; 206/398, 399, 407, 408; 242/579, 580, 580.1, 601, 606, 614, 156.1, 422.5

(56) References Cited

U.S. PATENT DOCUMENTS

| | | | | |
|---|---|---|---|---|
| 1,704,474 A | * | 3/1929 | Hayden et al. | 225/62 |
| 1,805,619 A | | 5/1931 | Fuller | |
| 1,869,729 A | | 8/1932 | Zuckerman | |
| D95,616 S | | 5/1935 | Ritter | |
| 2,044,791 A | * | 6/1936 | Hoffman | 206/398 |
| 2,082,546 A | | 6/1937 | Machate et al. | 206/52 |
| D125,085 S | | 2/1941 | Jackson | |
| 2,275,212 A | | 3/1942 | Valentine | 242/70 |
| 2,295,477 A | | 9/1942 | Jackson | 242/55.5 |
| 2,295,679 A | | 9/1942 | Montback | 242/55.5 |
| D134,545 S | | 12/1942 | Fischer | |
| D136,657 S | | 11/1943 | Funke | |
| 2,333,924 A | | 11/1943 | Gorbatenko | 164/47 |
| D141,220 S | | 5/1945 | Preble, Jr. | D74/1 |

(List continued on next page.)

OTHER PUBLICATIONS

"3M™ Micropore™ Surgical Tape, The dependable choice for a gentle, general dressing paper tape.", 3M Health Care, form 70–2008–5942–2(1251)ii, undated.

brochure, "3M Surgical Tape Sampler, Standards that never vary", 3M Health Care, form 70–2008–6471–1(532.5)ii, undated.

Johnson and Johnson "Wound Care Products", http://www.jnjindia.com/prowou.htm, undated.

2 copies of photographs of a prior art edge protector for use with Smith & Nephew medial tape rolls, which edge protector does not afford rotation of the roll of tape relative to the edge protector, undated.

Engineering drawings for the "Micropore #1535 1 Dispenser", 1 page, undated.

photographs of 3M tape dispensers, undated.

*Primary Examiner*—Kenneth E. Peterson
*Assistant Examiner*—Thomas J. Druan, Jr.
(74) *Attorney, Agent, or Firm*—Doreen S L Gwin

(57) ABSTRACT

A tape dispenser comprising a hub unit and a housing that can be removed from the hub unit to dispense tape. The hub unit comprises a hub for holding a roll of tape, and two flanges, one on each of the opposite ends of the hub. One of the flanges optionally has a cutting edge along a portion of its outer periphery for severing tape pulled over the cutting edge. A plurality of tabs are provided generally adjacent the periphery of at least one of the flanges. The tabs tend to prevent accidental unwinding of tape from the tape dispenser unit. The housing covers the periphery of the flanges (including the cutting edge if provided).

14 Claims, 4 Drawing Sheets

U.S. PATENT DOCUMENTS

| | | | | | |
|---|---|---|---|---|---|
| D164,733 | S | | 10/1951 | Pretzfedler, Jr. | D74/1 |
| 2,694,533 | A | | 11/1954 | Zucker | 242/55.4 |
| 2,695,454 | A | | 11/1954 | Dart | 33/138 |
| 2,699,251 | A | | 1/1955 | Rizza | 206/59 |
| 2,701,692 | A | * | 2/1955 | Guyer | 225/56 |
| 2,710,152 | A | | 6/1955 | Jones | 242/55.5 |
| D177,214 | S | | 3/1956 | Castelli et al. | D74/1 |
| 2,759,545 | A | * | 8/1956 | Rizza | 225/61 |
| 2,776,095 | A | | 1/1957 | Emmert | 242/55.5 |
| 2,790,609 | A | | 4/1957 | Hawthorne et al. | 242/55.5 |
| D185,284 | S | | 5/1959 | Hofmann | D74/1 |
| D185,639 | S | | 7/1959 | Hofmann | D74/1 |
| D186,343 | S | | 10/1959 | Gershen | D74/1 |
| D187,765 | S | | 4/1960 | Gershen | D74/1 |
| D188,519 | S | | 8/1960 | Gershen | D74/1 |
| D192,455 | S | | 3/1962 | Castelli | D58/26 |
| D192,835 | S | | 5/1962 | Wax | D74/1 |
| 3,035,345 | A | | 5/1962 | Barnard | 30/124 |
| 3,102,671 | A | | 9/1963 | Gershen | 225/43 |
| 3,121,021 | A | | 2/1964 | Copeland | 117/122 |
| 3,216,634 | A | | 11/1965 | Lausa | 225/19 |
| 3,677,495 | A | * | 7/1972 | Villers et al. | 206/408 |
| 3,762,261 | A | | 10/1973 | Ekenberg | 83/649 |
| 4,060,444 | A | | 11/1977 | Schweig, Jr. et al. | 156/391 |
| D260,368 | S | | 8/1981 | Dunshee et al. | D9/415 |
| 4,630,765 | A | | 12/1986 | Samuelson et al. | 225/96 |
| 4,700,835 | A | | 10/1987 | Rognsvoog, Jr. | 206/411 |
| D295,424 | S | | 4/1988 | Porter | D19/67 |
| 4,817,798 | A | * | 4/1989 | Huang | 225/77 |
| 4,998,655 | A | | 3/1991 | Huang | 225/26 |
| D323,531 | S | | 1/1992 | Fortune | D19/69 |
| 5,090,565 | A | | 2/1992 | Wang | 206/411 |
| 5,133,980 | A | | 7/1992 | Ream et al. | 426/115 |
| 5,154,335 | A | | 10/1992 | Bredow et al. | 225/40 |
| D338,493 | S | | 8/1993 | Mead | D19/69 |
| 5,294,068 | A | | 3/1994 | Baro et al. | 242/55.53 |
| 5,496,603 | A | | 3/1996 | Riedel et al. | 428/40 |
| 5,531,855 | A | | 7/1996 | Heinecke et al. | 156/252 |
| D379,474 | S | | 5/1997 | Packard | D19/69 |
| 5,631,073 | A | | 5/1997 | Riedel et al. | 442/364 |
| D380,777 | S | | 7/1997 | Packard | D19/69 |
| 5,679,190 | A | | 10/1997 | Riedel et al. | 156/62.2 |
| 5,698,067 | A | | 12/1997 | Packard | 156/577 |
| D392,676 | S | | 3/1998 | Hsu | D19/69 |
| 5,735,400 | A | | 4/1998 | Packard | 206/408 |
| 5,849,325 | A | | 12/1998 | Heinecke et al. | 424/443 |
| D416,582 | S | | 11/1999 | Dunshee et al. | D19/69 |

* cited by examiner

TAPE DISPENSER

CROSS REFERENCE TO RELATED APPLICATIONS

This application is a continuation-in-part of US design patent application Ser. No. 29/109,681, filed Aug. 20, 1999, which is a divisional of U.S. design patent application Ser. No. 29/097,492, filed Dec. 8, 1998, now U.S. Design Patent No. Des. 416,582.

TECHNICAL FIELD

The invention relates to tape dispensers for dispensing tape, for example, medical tape.

BACKGROUND OF THE INVENTION

Tape dispensers have been in widespread use for years. Tape dispensers have been used to dispense selected lengths of materials from a roll of tape, typically tape that includes a pressure sensitive adhesive. Tape dispensers that include serrations for severing tape have been in use, as have tape dispensers that are formed of one piece of material. One piece tape dispensers have been made that include exposed fixed serrations for severing tape. Problems with exposed fixed blades or serrations include some risk that tape will be inadvertently cut, and that clothing, drapes, surgical gowns, etc., will be snagged by the blade or serrations.

At least some prior tape dispensers have allowed non-tacky tape (e.g., non-adhesive tape or adhesive tape with the adhesive covered by a liner) to unravel from the dispenser prematurely. Non-tacky tape means tape having non-tacky opposite major surfaces as provided on the roll so that one of the major surfaces would not stick to the other major surface of the adjacent layer of the tape roll.

U.S. Pat. Nos. 5,735,400 and Des. 380,777 disclose a tape dispenser having a folded one piece design having a bridge member extending between two outer periphery portions. This tape dispenser does not include an integral cutting means. The outer layer of tape remains exposed in this design.

U.S. Pat. No. 5,735,400 describes a one-piece protector for a roll of tape having a releasable hub means, a transverse, peripheral bridge portion extending between outer peripheries of first and second walls.

The 3M Micropore™ tape dispenser is a folded one-piece design having an integral fixed serrated blade with central nested projections to provide a journal to mount the tape core. The outer layer of tape remains exposed in this design.

U.S. Design Patent No. 125,085 discloses a tape dispenser having a folded one-piece construction with a fixed serrated edge on the bridge member. U.S. Design Patent No. 164,733 discloses a tape dispenser frame having a fixed serrated blade and a tape land for the free end of the tape.

U.S. Pat. No. 2,295,679 describes a reusable tape dispenser stamped out from a single flat blank of sheet metal having a uniplaner base from which extend opposed parallel sides and spaced by the base to a width to accommodate the width of the tape core. Each side portion has a centrally located projection to support the tape core. A fixed cutting blade is located on the base.

SUMMARY OF THE INVENTION

This invention provides, in one aspect, a tape dispenser that will better retain non-tacky tape on the dispenser ready for dispensing without premature unraveling of the tape from the dispenser, and, in another aspect, a tape dispenser having a cutting edge along a flange for cutting tape (tacky or non-tacky) that is pulled over the cutting edge wherein the cutting edge is protected or covered by a removable housing when tape is not being dispensed. In yet another aspect, the hub unit or spool of the tape dispenser is integrally formed of one piece of material molded and folded into its final configuration.

Generally, in one aspect, the tape dispenser unit of the invention comprises a hub having opposite ends, and a flange on each of the opposite ends of the hub. The hub is adapted to hold a roll of tape. Each flange has an outer periphery, and one of the flanges having a cutting edge along a portion of its outer periphery for severing tape pulled over the cutting edge.

Preferably, the cutting edge comprises a plurality of teeth arranged along an otherwise generally straight edge portion of the periphery.

Preferably, a hub portion extends from each flange for connection to a hub portion on the other flange to form the hub. Most preferably, the hub portions are mechanically connected together.

Alternatively, a bridge portion joins a portion of the periphery of each flange to the periphery of the other flange, and the hub unit consists essentially of one integral piece of material folded to form the unit.

Preferably, a housing removably receives the hub unit, with the housing covering the cutting edge when the hub unit is fully inserted into the housing.

Most preferably, the housing includes a generally tubular section for enclosing the outer periphery of the flanges when the hub unit is fully inserted into the housing. Most preferably, the housing is open at one end of the tubular section to allow the hub unit to be inserted into the housing, and has a flange extending radially inwardly adjacent the other end to resist pushing the hub unit beyond the flange. Preferably, the tubular section is sized and configured such that the cutting edge can be received adjacent the open end of the housing but not the end with the inwardly extending flange.

Alternatively, the housing further comprising an open end and a closed end at opposite ends of the tubular section, with the tubular section being sized and configured such that the cutting edge can be received adjacent the open end of the housing but not the closed end.

Preferably, at least one of the flanges further includes a plurality of tabs generally adjacent the periphery of the flange extending in the direction toward the other flange. The tabs tend to prevent accidental unwinding of tape from the tape dispenser unit. Most preferably, the generally tubular portion of the housing has an inside surface with a plurality of corners corresponding to the tabs so that the corners and tabs register together when the hub unit is fully inserted into the housing.

In another aspect of the invention, the tape dispenser generally comprises a hub unit having a hub having opposite ends, and a housing for removably receiving the hub unit. The hub is adapted to hold a roll of tape. A flange is provided on each of the opposite ends of the hub. Each flange has a periphery, and at least one of the flanges further includes a plurality of tabs generally adjacent the periphery of the flange extending in the direction toward the other flange. The tabs tend to prevent accidental unwinding of tape from the tape dispenser. The housing has a generally tubular section for enclosing the outer periphery of the flanges when the hub unit is fully inserted into the housing. The generally tubular portion of the housing has an inside surface with a plurality of corners corresponding to the tabs so that the corners and tabs register together when the hub unit is fully inserted into the housing.

Preferably, the tabs are only provided on one flange, and the corners are only provided adjacent one end of the tubular section.

These and other features and advantages of the invention will be pointed out hereinafter.

BRIEF DESCRIPTION OF THE DRAWINGS

The invention will be further described with reference to the drawing wherein corresponding reference characters indicate corresponding parts throughout the several views of the drawing, and wherein.

DETAILED DESCRIPTION OF PREFERRED EMBODIMENTS

Figure 1:
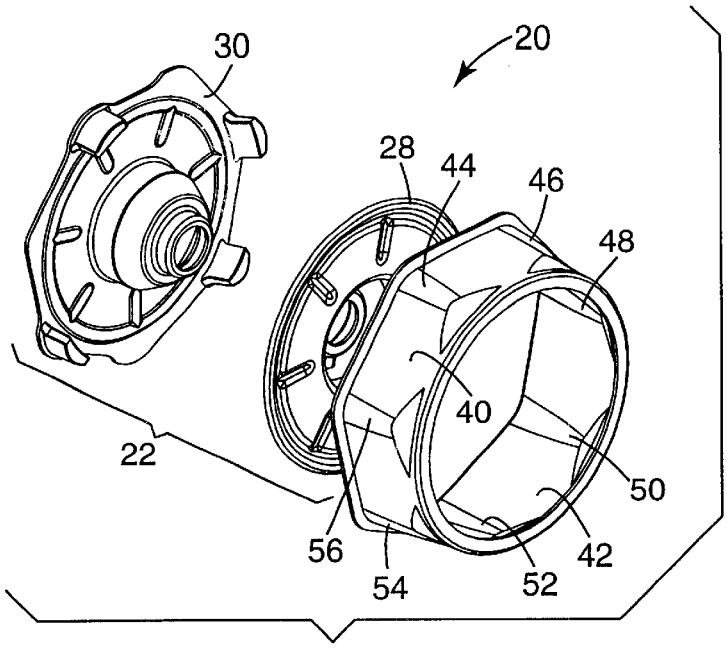
FIG. 1 is an exploded view of a preferred embodiment of the tape dispenser of the invention.
Figure 2:
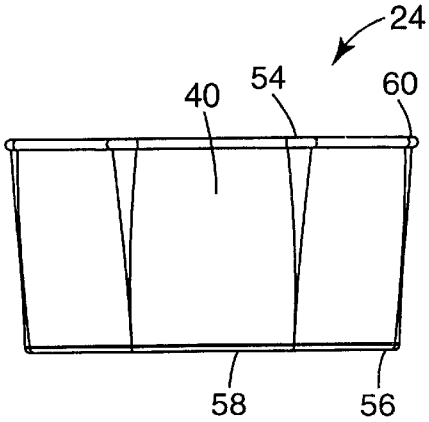
FIG. 2 is a side view of the tape dispenser of FIG. 1.
Figure 2A:
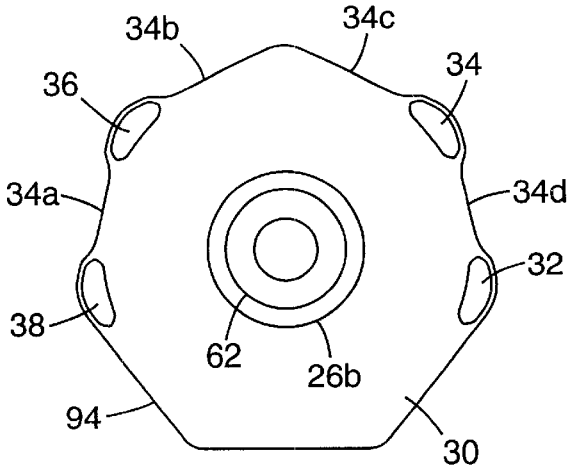
FIG. 2*a* is a bottom view of a hub portion and flange of the tape dispenser of FIG. 2.
Figure 3:
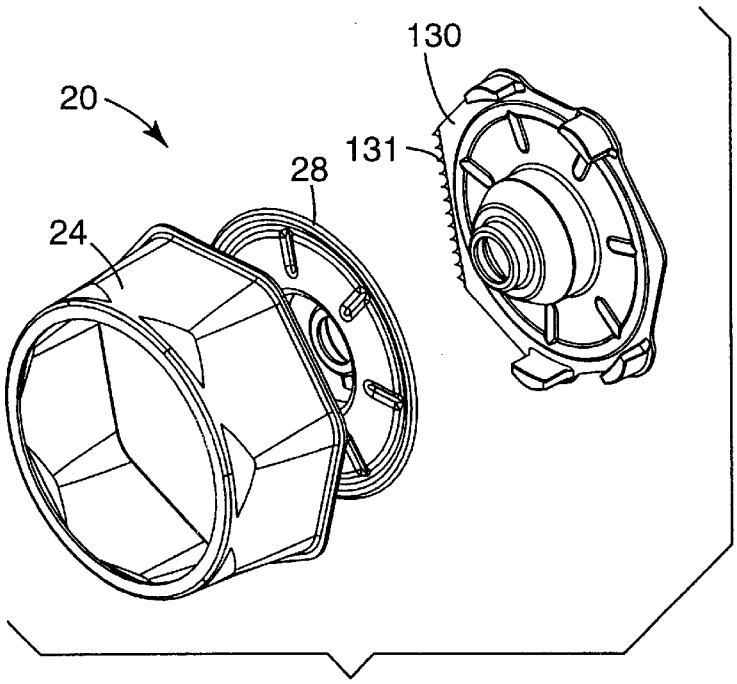
FIG. 3 is a second exploded view of a second embodiment of the tape dispenser.
Figure 4:
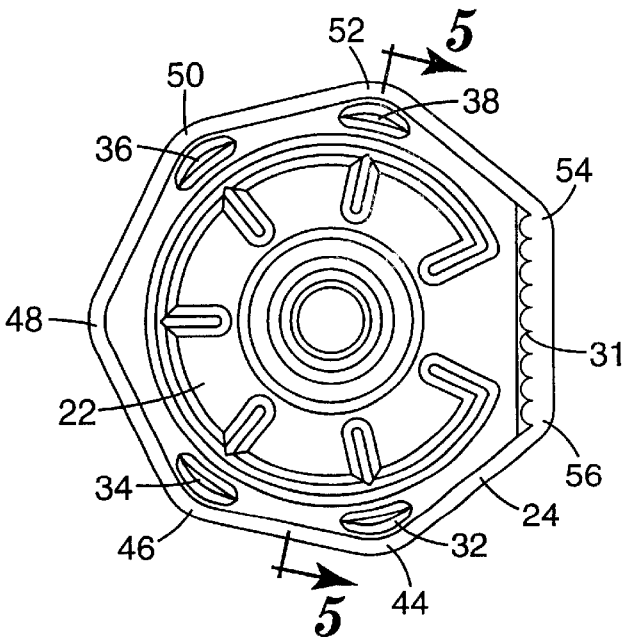
FIG. 4 is a back view of the tape dispenser of FIG. 3.

Now referring to the drawings, and in particular FIGS. 1–2, the tape dispenser of this invention is designated in its entirety by the reference numeral 20. The tape dispenser 20 generally comprises a hub unit 22 and housing 24. The same reference characters are used for the second embodiment (FIGS. 3–7) as for the first (FIGS. 1–2), except that the second embodiment is designated in its entirety by reference numeral 120, and different reference numerals are used if the specific feature does not appear on the other embodiment.

The hub unit 22 includes a hub 26 adapted to hold a roll of tape, and a flange 28 and 30 on each of the opposite ends of the hub 26. Each flange 28 and 30 has a periphery 92, 94. Preferably, at least one of the flanges 30 further includes a plurality of tabs (e.g., four tabs 32, 34, 36 and 38) generally adjacent the periphery 94 of the flange 30. The tabs 32, 34, 36 and 38 extend in the direction generally toward the periphery 92 of the other flange 28, and the tabs 32, 34, 36 and 38 tend to prevent accidental unwinding of tape from the tape dispenser 20. Preferably, the tabs 32, 34, 36 and 38 are only provided on one flange 30.

Figure 5:
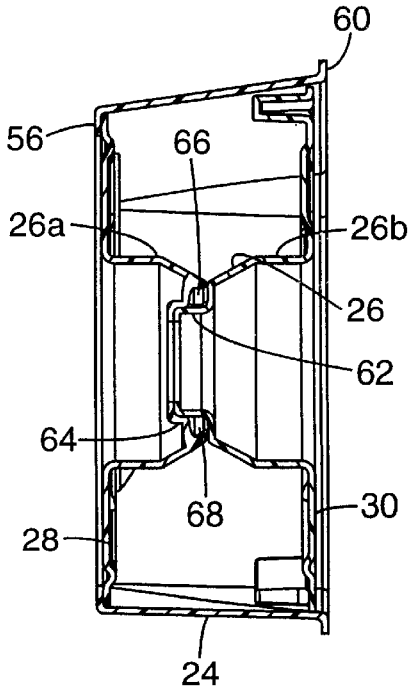
FIG. 5 is a cross-sectional view substantially along line 5—5 in FIG. 4.
Figure 6:
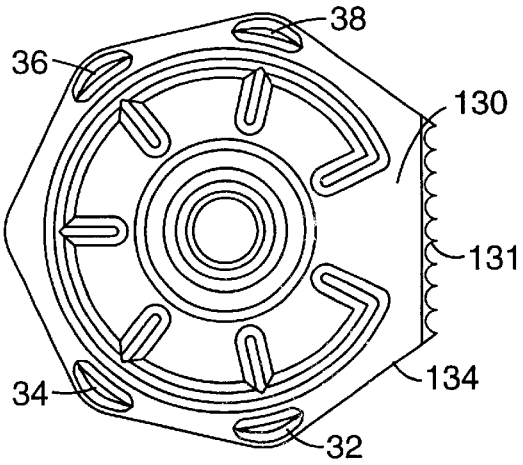
FIG. 6 is a bottom view of a hub unit of the tape dispenser of FIGS. 3–5.
Figure 5A:
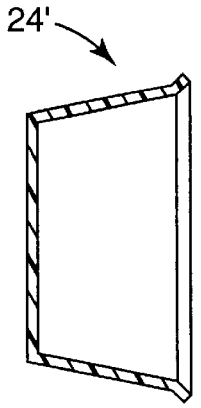
Figure 7:
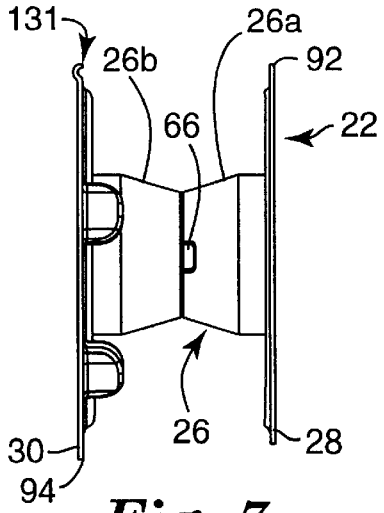
FIG. 7 is a side view of the hub unit of FIG. 6.
Figure 8:
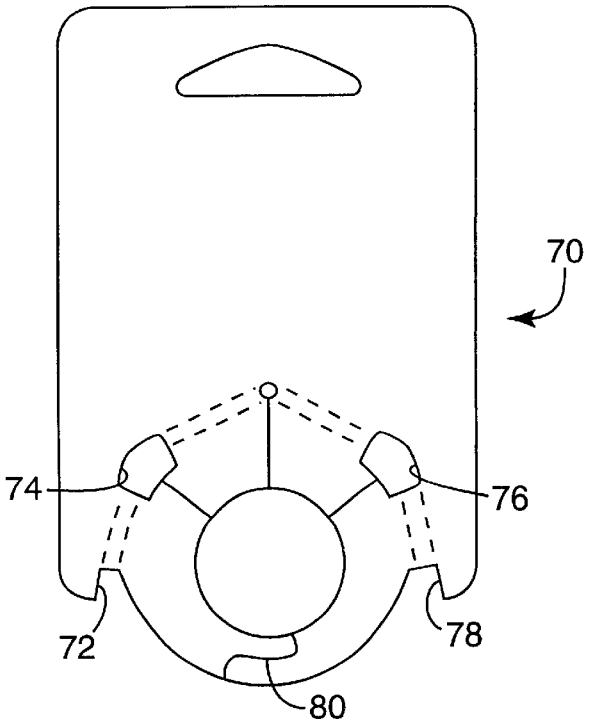
FIG. 8 is a front view of a product card for use with either the first or second embodiment of the tape dispenser.

Preferably, the flanges 28 and 30 lie along parallel planes to each other, and the hub 26 extends in a direction generally perpendicular to the planes of the flanges 28 and 30. The hub 26 preferably provides a generally round outer surface, which may taper inwardly generally adjacent the central region as illustrated in FIG. 5.

The housing 24 removably receives the hub unit 22 to enclose the roll of tape. The housing 24 has a generally tubular section 40 preferably for enclosing (covering) the outer peripheries 32, 34 of the flanges 28, 30 when the hub unit 22 is fully inserted into the housing 24. The hub unit 22 is substantially removed from the housing 24 to dispense tape from the tape dispenser 20, 120.

As best illustrated in FIG. 1, the generally tubular portion 40 of the housing 24 has an inside surface 42 with a plurality (e.g., 7) of corners 44, 46, 48, 50, 52, 54 and 56, at least some of which correspond to the tabs 32, 34, 36 and 38 so that the corners 44, 46, 50 and 52 and tabs 32, 34, 36 and 38 register together when the hub unit 22 is fully inserted into the housing 24. It will be appreciated that if the tabs 32, 34, 36 and 38 are provided on only one flange 30 (as is preferred), the corners 44, 46, 50 and 52 would only need to be provided adjacent one end of the tubular section 40 to obtain this registration between corners and tabs.

The tabs 32, 34, 36, and 38 help prevent the self unwinding of a non-sticky tape 202 if the distance between the tabs 32, 34, 36 and 38 and the opposite flange 28 is less than the tape width. Preferably, the tape roll 200 is allowed to rotate on the hub 26 so that the tape 202 can still be pulled through between the tabs 32, 34, 36 and 38 without interference by the tabs 32, 34, 36 and 38.

The tabs 32, 34, 36 and 38 also prevent the housing 24 from fully enclosing/engaging if there is misalignment between the corners 44, 46, 50 and 52 of the housing 24 and tabs 32, 34, 36 and 38 on the hub unit 22. The tabs 32, 34, 36 and 38 tend to self-align the hub unit 22 within the housing 24 as the hub unit 22 is fully inserted into the housing 24 to obtain the desired registration between the corners and tabs.

Most preferably, the housing 24 is open at one end 54 of the tubular section 40 to allow the hub unit 22 to be inserted into the housing 24, and has a flange 56 extending radially inwardly adjacent the other end 58 to resist pushing the hub unit 22 beyond the flange 58. The open end 54 may have radially outwardly extending flange 60. Alternatively, the housing may have an open end and a closed end at opposite ends of the tubular section.

Also, preferably, the hub 26 comprises two hub portions 26*a*, 26*b*, one extending from each flange 28, 30 for connection to the other hub portion 26*b*, 26*a*. For example, the hub portions 26*a*, 26*b* may be mechanically connected together, such as by "snap-fit" or interference fit between two resiliently flexible materials. Most preferably, one hub portion 26*b* includes a male generally cylindrical portion 62 that is resiliently received within a female generally cylindrical opening 64 in the other hub portion 26*a*. The hub portion 26*a* forming the female connecting surfaces 64 is preferably provided with two slots 66, 68 that facilitate this connection.

The tabs 32, 34, 36 and 38 also facilitate connection of a product card 70 to the tape dispenser 20. The product card 70 includes open areas/edges 72, 74, 76 and 78 for receiving the tabs 32, 34, 36 and 38 to hold the product card 70 in position. The product card 70 may also include a preferably non-linear slit 80 into circular open area 82 to facilitate mounting the product card 70 on the hub unit 22 after the hub unit 22 is assembled.

The second embodiment of the tape dispenser 120 includes a cutting edge 131 along a portion (also 131) of the outer periphery of flange 130 for severing tape pulled over the cutting edge 131. For example, the cutting edge 131 may be in the form of a plurality of teeth (also 131) arranged along an otherwise generally straight edge portion of the periphery of flange 130.

The tubular section of the housing 24 covers the cutting edge 131 when the hub unit 22 is fully inserted into the housing 24. The periphery 94 of the flange 130 and teeth 131 are preferably completely recessed/enclosed within the housing 24. In this position, the teeth 131 are protected from breakage and dulling and the casual handler of the tape dispenser 120 is protected from the pointed tearing edge 131.

Most preferably, the teeth 131 extend at an oblique angle to the flange 130. The teeth 131 are preferably cut into a thermoformed or molded ridge so that the points of the teeth 131 are positioned at the bottom of the ridge. This has the effect of curling the teeth points toward the tape roll 200 allowing the engagement of the points into the tape 202 backing at an angle that more aggressively tears into the backing of the tape 202. The force of tearing the tape pulls the teeth 131 into the tape 202 instead of bending the teeth 131 away from the tears.

Rather than a cutting edge, the first embodiment of the tape dispenser 20 illustrates the periphery 94 of the flange 30 as having four generally concave edge segments 34*a*, 34*b*, 34*c* and 34*d*. These concave edge segments facilitate the fit of the product card 70. It will be appreciated that the concave edge segments 34*a*, 34*b*, 34*c* and 34*d* of the first embodiment and cutting edge 131 of the second embodiment could be combined into a third embodiment of the tape dispenser.

In both the first and second preferred embodiments, the first flange 28 has a generally circular periphery 92 whereas the periphery 94 of the second flange 30/130 has a plurality of either generally linear or concave segments extending between a plurality of corners. The tubular section of the housing 24 in the first and second preferred embodiments also includes a generally circular end and a substantially multi-sided configuration adjacent the opposite end. The combination of the circular and multi-faceted/segmented/sided configurations is preferred for aesthetic reasons, and is illustrated in co-owned U.S. Design Patent No. 416,582, issued Nov. 16, 1999.

Also, as used herein, "tape" means any tape, either with or without an adhesive coating. Preferred tapes with a pressure sensing adhesive include the medical tapes available under the trade designation "MICROPORE" or "MICROPORE II" from Minnesota Mining and Manufacturing Company, St. Paul, Minn. One such tape is disclosed in U.S. Pat. No. 3,121,021 (Copeland), which is incorporated herein by reference. See, also, U.S. Pat. Nos. 5,496,603; 5,631,073 and 5,679,190, which are also incorporated herein by reference.

Figure 9:
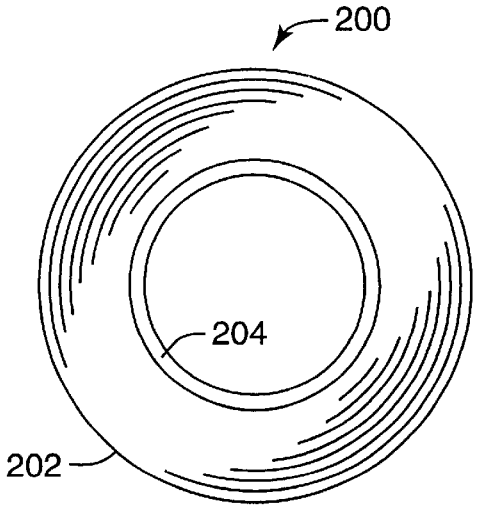
FIG. 9 is a side view of a roll of tape for use in the tape dispenser.

As illustrated in FIG. 9, the roll 200 of tape 202 typically comprises a core 204 (e.g., a cardboard core) around which the tape 202 is wound. The pressure sensitive adhesive is optionally provided on at least one major surface of the tape backing. A low adhesive backsize may be provided on the opposite major surface of the tape 202, or a release liner (not shown) may be provided over the pressure sensitive adhesive. The tape backing may be of any construction: for example, paper, nonwoven (e.g., carded, meltblown or spunbond), plastic or cloth. Alternatively, the roll of tape may be provided without a core.

Most preferably, both of the major opposite surfaces of the tape 202 are non-tacky as provided on the roll 200 or within the tape dispenser. Preferred non-tacky tapes include tapes lacking adhesive surfaces and adhesive tapes having an adhesive surface covered by a release liner.

As used herein, "tape dispenser unit" means the hub unit 22 but excludes the housing 24, whereas the term "tape dispenser" includes both the hub unit 22 and housing 24.

In one preferred embodiment, the hub unit 22 is formed of white plastic material, and the housing 24 is formed of substantially transparent plastic material. As used in this context, "plastic" means synthetic resin, thermoset or thermoplastic materials.

The tape dispenser 20 is preferably constructed from inexpensive plastic material selected from the group consisting of polystyrene, polypropylene, polyethylene, polycarbonate, and acetal resin (such as sold under the tradename "CELCON" by Celanese Chemical Company, or "DELRIN" by E.I. DuPont de Nemours & Company, Wilmington, Del.). For example, part of the tape dispenser may be injection molded of polypropylene material.

Figure 10:
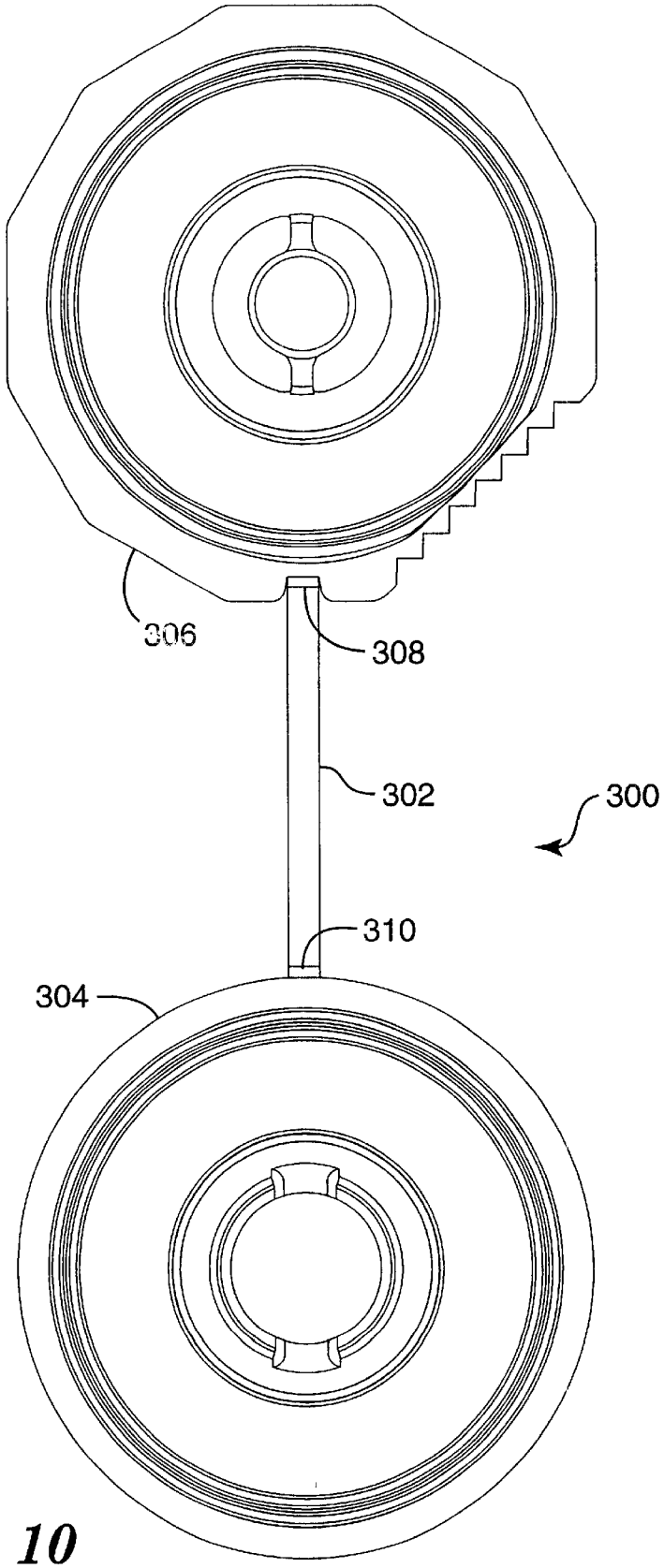
FIG. 10 is a top view of a hub unit blank of an alternative design in which the hub unit is integrally molded of one piece of material and then folded to form the hub unit.

FIG. 10 illustrates yet another embodiment of the hub unit formed from a hub unit blank designated in its entirety 300. The hub unit blank 300 includes a bridge portion 302 joining a portion of the periphery of each flange 304, 306 to the periphery of the other flange 306, 304. In this embodiment, the hub unit blank 300 consists essentially of one integral piece of material folded to form the hub unit. The hub unit formed by this blank 300 may otherwise be identical to the hub units of the first or second embodiments of the tape dispenser 20, 120.

As used herein, the terms, "single part", "single piece", "integral" and "one piece construction" mean formed in one continuous piece, for example, by injection molding, vacuum forming, pressure thermoforming, casting, etc., as opposed to formed by connecting separate pieces, for example, mechanically, with adhesive or by welding. The term "single" is intended to exclude the plural, e.g., a "single" part means only one part and not one or more parts.

The bridge portion 302 of the hub unit blank 300 is joined to the flanges 304, 306 by living hinges 308 and 310. As used herein, the term "living hinge" means a hinge integrally formed with the opposite flanges and bridge of the same material. Typically the material along the living hinge is thin relative to the adjacent areas to facilitate flexing or bending of the opposite flanges 304, 306 relative to the bridge 302.

As used in connection with the hub unit blank 300, the term "assembled" means the roll 200 of tape 202 is place on the one piece blank 300, and the blank 300 is folded into its configuration for use. In this context, "assembled" does not require assembly of separate components to form the hub unit since the hub unit is formed by a one piece blank.

As various changes could be made in the above constructions and methods without departing from the scope of the invention as defined in the claims, it is intended that all matter contained in the above description or shown in the accompanying drawings be interpreted as illustrative and not in a limiting sense.

What is claimed is:

1. A tape dispenser for dispensing tape, the tape dispenser comprising:

hub unit having a hub having opposite ends, the hub being adapted to hold a roll of tape, and a flange on each of the opposite ends of the hub, each flange having a periphery, at least one of the flanges further including a plurality of tabs generally adjacent the periphery of the flange extending in the direction toward the other flange, the tabs tending to prevent accidental unwinding of tape from the tape dispenser; and a housing for removably receiving the hub unit, the housing having a generally tubular section for enclosing the outer periphery of the flanges when the hub unit is fully inserted into the housing, the generally tubular portion of the housing having an inside surface with a plurality of corners corresponding to the tabs so that the corners and tabs register together when the hub unit is fully inserted into the housing.

2. The tape dispenser according to claim 1 wherein the tabs are only provided on one flange.

3. The tape dispenser according to claim 1 wherein the tubular section of the housing has opposite ends, the housing further comprising an open end and a closed end at opposite ends of the tubular section.

4. The tape dispenser according to claim 1 wherein the tubular section of the housing has opposite ends, the housing being open at one end of the tubular section to allow the hub unit to be inserted into the housing and having a flange extending radially inwardly adjacent the other end to resist pushing the hub unit beyond the flange.

5. The tape dispenser according to claim 4 wherein the hub unit includes a bridge portion joining a portion of the periphery of each flange to the periphery of the other flange, and the hub includes a hub portion extending from each flange for connection to the other hub portion, the hub unit consisting essentially of one integral piece of material folded to form the hub unit.

6. The tape dispenser according to claim 5 wherein the hub portions are mechanically connected together.

7. A combination of the tape dispenser according to claim 1 and a roll of tape, the tape including opposite major surfaces both of which are non-tacky as provided on the roll.

8. A tape dispenser for dispensing tape, the tape dispenser comprising:

a hub unit comprising a hub having opposite ends, the hub being adapted to hold a roll of tape, and a flange on each of the opposite ends of the hub, wherein each flange has a periphery, wherein one flange comprises a plurality of tabs generally adjacent the periphery of the flange extending in the direction toward the other flange, and further wherein the tabs are configured to prevent accidental unwinding of tape from the tape dispenser; and a housing for removably receiving the hub unit, the housing comprising a generally tubular section for enclosing the outer periphery of the flanges when the hub unit is fully inserted into the housing, the generally tubular section of the housing comprising an inside surface with a plurality of corners corresponding to the tabs so that the corners and tabs register together when the hub unit is fully inserted into the housing, wherein the tubular section comprises opposite ends, and further wherein the corners are only provided adjacent one end of the tubular section.

9. The tape dispenser according to claim 8, wherein the housing further comprises an open end and a closed end at opposite ends of the tubular section.

10. The tape dispenser of claim 8, wherein the housing further comprises an open end at one end of the tubular section, wherein the open end allows the hub unit to be inserted into the housing, and further wherein the housing comprises a flange extending radially inwardly adjacent the end opposite the open end of the tubular section, wherein the flange prevents the hub unit from being inserted beyond the flange.

11. The tape dispenser according to claim 8, wherein the hub unit comprises a bridge portion joining a portion of the periphery of each flange to the periphery of the other flange; wherein the hub comprises a hub portion extending from each flange for connection to the other hub portion, the hub unit consisting essentially of one integral piece of material folded to form the hub unit.

12. The tape dispenser according to claim 11, wherein the hub portions are mechanically connected together.

13. A combination of the tape dispenser according to claim 8 and a roll of tape, the tape comprising opposite major surfaces both of which are non-tacky as provided in the roll.

14. A method for dispensing tape, the method comprising:

providing a tape dispenser, the tape dispenser comprising:

a hub unit comprising a hub having opposite ends, the hub being adapted to hold a roll of tape, and a flange on each of the opposite ends of the hub, wherein each flange has a periphery, wherein one flange comprises a plurality of tabs generally adjacent the periphery of the flange extending in the direction toward the other flange, and further wherein the tabs are configured to prevent accidental unwinding of tape from the tape dispenser; and a housing for removably receiving the hub unit, the housing comprising a generally tubular section for enclosing the outer periphery of the flanges when the hub unit is fully inserted into the housing, the generally tubular section of the housing comprising an inside surface with a plurality of corners corresponding to the tabs so that the corners and tabs register together when the hub unit is fully inserted into the housing, wherein the tubular section comprises opposite ends, and further wherein the corners are only provided adjacent one end of the tubular section; and a roll of tape, the tape comprising opposite major surfaces both of which are non-tacky as provided on the roll, wherein the roll of tape is located on the hub;

removing the housing from the hub unit;

grasping an exposed end of the roll of tape;

pulling the exposed end of the roll of tape to a selected length; and tearing the selected length of tape.

* * * * *

UNITED STATES PATENT AND TRADEMARK OFFICE

CERTIFICATE OF CORRECTION

PATENT NO. : 6,364,188 B1
DATED : April 2, 2002
INVENTOR(S) : Dunshee, Wayne K.

It is certified that error appears in the above-identified patent and that said Letters Patent is hereby corrected as shown below:

Title page,
Item [76], "Wayne K. Dunshee, P.O. Box 33427, St. Paul, MN (US) 55133-3427" should read -- Wayne K. Dunshee, Maplewood, MN (US) --.

Signed and Sealed this

Sixth Day of May, 2003

JAMES E. ROGAN
*Director of the United States Patent and Trademark Office*